United States Patent [19]

Heiman

[11] 4,392,335

[45] Jul. 12, 1983

[54] FLEXIBLE CEMENTITIOUS COATINGS

[75] Inventor: Robert B. Heiman, Los Angeles, Calif.

[73] Assignee: Astro-Steel Grip International, Inc., San Francisco, Calif.

[21] Appl. No.: 368,211

[22] Filed: Apr. 12, 1982

[51] Int. Cl.[3] ..... E01C 15/00; B05D 3/00; B32B 13/04

[52] U.S. Cl. ..... 52/309.17; 52/514; 52/741; 404/17; 404/82; 427/136; 428/413; 428/446; 428/703

[58] Field of Search ..... 428/413, 446, 703, 213, 428/215; 52/309.16, 309.17, 363, 454, 514; 404/17, 82; 427/136, 140

[56] References Cited

U.S. PATENT DOCUMENTS

| | | | |
|---|---|---|---|
| 3,949,144 | 4/1976 | Duff | 428/703 X |
| 3,984,266 | 10/1976 | Christensen et al. | 428/703 X |
| 4,120,131 | 10/1978 | Carroll | 52/310 X |
| 4,168,924 | 9/1979 | Draper et al. | 428/703 X |
| 4,193,831 | 3/1980 | Fujii et al. | 428/703 X |
| 4,265,957 | 5/1981 | Severance et al. | 428/413 X |
| 4,296,167 | 10/1981 | Ceintrey | 404/82 X |
| 4,296,364 | 9/1981 | Wesch et al. | 52/309.17 X |

*Primary Examiner*—William J. Van Balen
*Attorney, Agent, or Firm*—Grover A. Frater

[57] ABSTRACT

A repair overlay for masonry surfaces includes three layers each containing epoxy resins which contribute to bonding to the adjacent layers. The underlayer is a coating of epoxy adhesive. The layer that overlies the underlayer includes Portland cement and epoxy, acrylic and vinyl polymers and, in some forms, a flexible metal mesh or screen. The overlayer consists of an epoxy paint and, in preferred form, a second thinner layer of cementitious polymer bearing material.

19 Claims, 2 Drawing Figures

FLEXIBLE CEMENTITIOUS COATINGS

TECHNICAL FIELD

This invention relates to flexible cementitious coatings, and to the manner in which they can be applied over the surface of a base material.

BACKGROUND ART

Coating materials of the kind that are spread over a base surface have long been used in an effort to satisfy decorative and protective goals. Paint, originally a decorative coloring material, can afford protection from weathering. Development to improve adhesion, durability and easier application, along with improved protection, lead to the use of polymeric materials in paints.

The decoration of cement products and surfaces and their protection led to the development of flexible mortars. These mortars, which flex only imperceptably but far more than concrete, are essentially Portland cement mortars to which polymers are added. The three main ingredients of cement, tricalcium silicate, and dicalcium silicate, and tricalcium aluminate, hydrolize at different rates. The addition of polymers modifies the hardening process in a way that is not well understood. Different polymer additives modify properties in the hardening process and in the end result which suggests differences not only in degree but in the process itself. As a consequence, improvements are discovered rather than engineered. A number of cement-plastic combinations have been discovered to provide acceptable results as protective back plasters and decorative concrete overcoatings, even as protective overcoatings for roofs.

What has not been found is a paint or mortar which is a suitable repair material for concrete. Paints and mortars have not been made in a form that permits their use as a structural, load bearing element. It has not been possible to repair a sidewalk or a road by applying a layer of paint or of mortar to the sidewalk or road surface. Integrity of a cementitious overcoating is not assured in previously known materials until the thickness is so great as to constitute a new sidewalk or road. No cementitious compound or system has been known which can compete with asphalt as a repair material for concrete sidewalks, driveways, parking lots and roads. This invention provides such a material and "systems" of materials.

DISCLOSURE OF INVENTION

An object of the invention is to provide materials and a method of material application for repairing deteriorated concrete surfaces. While the repair of load bearing surfaces, like walkways and roads, is considered to be a more important application of the invention, it can be applied for decorative and weather proofing purposes, and to provide materials and methods for such uses is another object of the invention.

A further object is to provide an overcoating for roads and sidewalks and the like which is superior to asphalt as a protective and structural repair material and which is competitive with asphalt in terms of cost of material, cost of application labor, and energy costs.

The invention provides an overcoating for a base material, usually concrete, but also for stone, bricks, and tile, and even asphalts. The overcoating comprises multiple layers each of which bonds both to the material below and above except in the case of metal reinforcing screen. Some forms of the invention employ metal mesh screening or expanded metal. While the other materials incorporate substances which will bond to the metal, the metal does not include a bonding constituent. Other than that, a feature of the invention is that the ingredients of each layer include one or more which serves to create a bond with the next adjacent layers.

The several forms of the invention include an adhesive undercoat whose function is to form a bond with the base material being overcoated, and with an overlying layer of cementitious polymer material. The underlayer is usually quite thin. Its compressive strength need not be great, but in the preferred forms of the invention, it is capable of filling voids and cracks and interstices at the surface of the base material. In preferred form, it serves as a moisture barrier which stabilizes the base material against further deterioration by moisture borne ions. Preferred adhesive undercoats include chlorinated rubber and butyl celulose acetate solvant, in addition to epoxy adhesive.

In each case, the invention includes a "flexible" cementitious layer bonded to the underlayer because of interaction between bonding agents in the cementitious layer and in the underlayer. The preferred forms include epoxy resins in both layers and hardening catalysts and solvents arranged to increase bonding effectiveness. The cementitious layer exhibits high compressive strength which is uniform over a wide temperature range. Further, it is flexible in a degree that is sufficient to permit accommodation to cracking and small variation in level and crack size in the base material, without interrupting structural integrity of the overlayer. That facility is provided in preferred embodiments by acrylic polymers and chlorinated vinyl rubber. They are combined with epoxy resins in a water emulsion which is added to the Portland cement and, if used, a sand filler. Hydrophobic forms of acrylic and epoxy polymers are used.

When used in roadway and sidewalk repair, a sheet of expanded metal or screening of the kind used in plaster installation is laid over the adhesive undercoat and fastened with mechanical fasteners to the base concrete. Laid before the undercoat is completely hard, the lower surface of the expanded metal sheet may be pressed into the underlayer. While not essential, that process ensures a direct bond of the metal to both the underlayer and the cementitious layer. The latter is poured over the metal and undercoat, and trowled into intimate contact with both.

While not always required, it is usually preferred to seal the upper surface of the cementitious layer with a thin coat of an epoxy sealer which incorporates ultraviolet protection additives. That layer is covered with a thin layer of the sealer material mixed with Portland cement and an emulsion of the same acrylic and epoxy polymers that were employed in the cementitious layer.

If a textured upper surface, or a "non-slip" surface, is required, sand or other texturing material may be added to this sealer, plus cement layer along with coloring. Finally, in the case of a sidewalk or other use in which loading is not heavy and decoration is desired, the upper sealer and cement layer may be painted with one or more coats of epoxy paint, the last of which should include little or not solvent thinner.

DESCRIPTION OF THE PREFERRED EMBODIMENT

Figure 1:
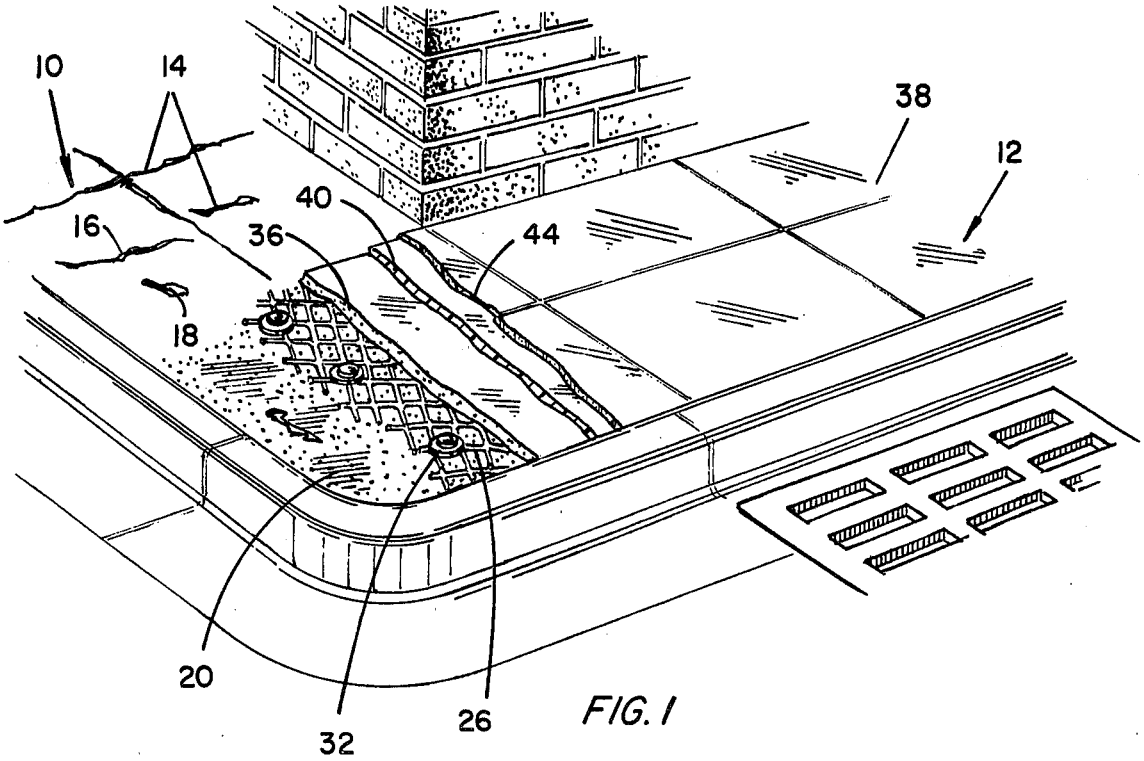
FIG. 1 is an isometric view of a street corner showing a sidewalk a portion of which has been repaired according to the preferred method of the invention and which employs the preferred materials of the invention.

In FIG. 1, the sidewalk 10 at the left meets the sidewalk 12 at the corner. Grooves, like grooves 14 in the walk at the left, were formed in both walks when the walk was laid to accommodate contraction and expansion. Cracks, like crack 16, and spalling, as at 18, cannot be repaired with patching cements, and to resurface the walk with a thin layer of conventional mortar or concrete will not be an effective repair technique because a think overlayer of previously known overlayer will crack and separate from the old sidewalk base.

The sidewalk at the right has been repaired to the region of the corner using the preferred materials and methods of the invention. After being washed with water and dried, the walk at the right was coated with an epoxy paint. Epoxy resin and hardening catalyst thinned with butyl celulose acetate was applied with a paint roller to form a coating less than one millimeter thick. The paint mixture was thinned so that it would seep into surface interstices and cracks in the old concrete surface. The epoxy hardens to form molecules within the cracks and surface openings to effect a mechanical bond as well as an electro-chemical bond between the paint and the old concrete.

Figure 2:
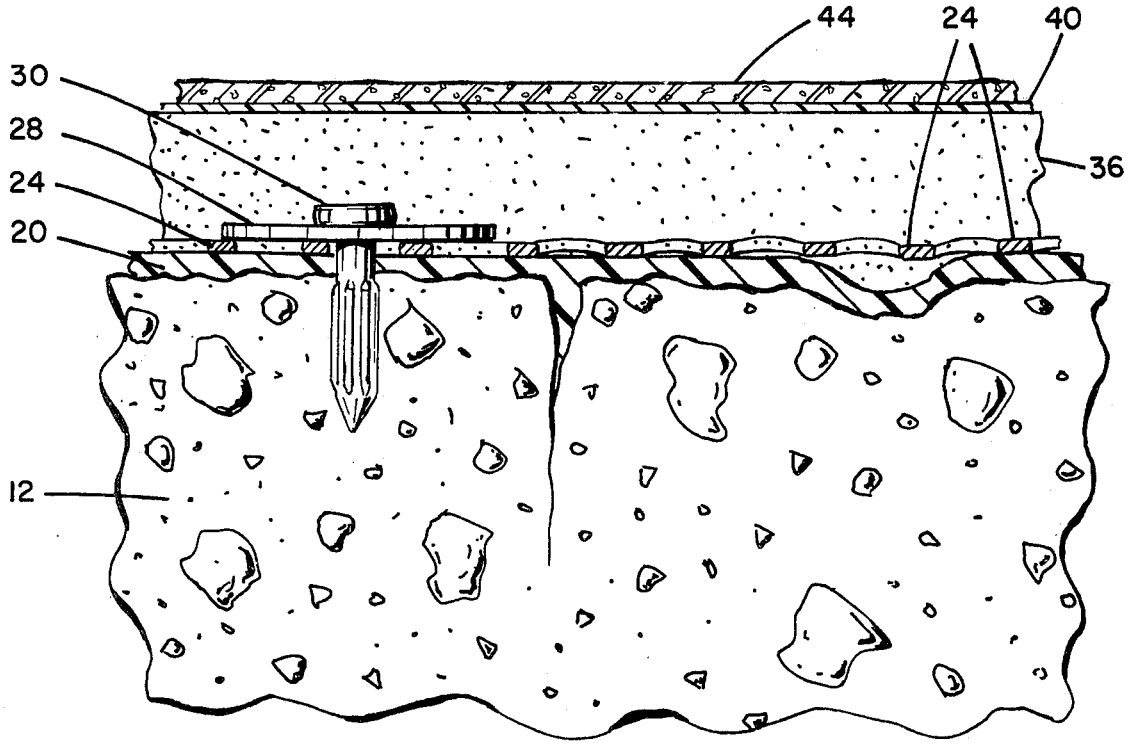
FIG. 2 is a cross-sectional view taken on a vertical plane showing a fraction of the original sidewalk and the overlying repair system of FIG. 1.

An area 20 is shown to be covered with the undercoat of adhesive paint and is identified by the numeral 22 in FIG. 2 where it overlies the original concrete sidewalk 12.

When the adhesive paint layer has dried sufficiently to permit foot traffic, the expanded metal mesh is laid over the adhesive layer. The mesh is approximately two millimeters thick, and its cut edges are visible in FIG. 2 where some cut ends are numbered 24. A portion of a sheet of the expanded metal is visible in FIG. 1 where it is numbered 26. The sheet may be forced down with a weighted roller or otherwise so that its lower surfaces are embedded in the adhesive layer as best shown in FIG. 2.

Concrete fasteners mechanically secure the expanded metal mesh or screen to the old concrete base. A washer overlies the mesh and a concrete nail is driven through the washer and metal mesh and the adhesive layer into the concrete using an explosive nail driver. Such a combination of washer and nail is visible in FIG. 2 where the washer is numbered 28 and the nail is numbered 30. Some of the fasteners are visible in FIG. 1. One has been numbered 32.

The cementitious layer is laid next. Three hundred pounds of thirty mesh silica sand are mixed dry with fifty pounds of Portland cement type I or type II. Water is added to form a slurry, creamy consistency suitable for pumping. One quart of polymer emulsion is then blended into the water sand cement mixture. The emulsion is half water. The remainder is made up of equal parts of acrylic resin, epoxy resin, and catalyst, and about ten percent by volume of vinyl rubber.

The resulting blend is permitted to stand undisturbed for ten or fifteen minutes during which time hydrolysis of the tricalcium silicate and tricalcium aluminate begins and, it seems, some migration of the polymer molecules takes place. The polymers are hydrophobic. It is theorized that the polymers form a film around the water wetted surfaces of sand grains and crystal lattice elements form during initial hydrolysis.

After that initial short setting time, the mixture is thoroughly mixed again, and it is poured over the expanded mesh screen and trowelled and worked to a thickness which is ordinarily not less than one-fourth inch or six millimeters. The upper limit of thickness is less critical, but ordinarily should not exceed one inch or twenty-five millimeters. A lesser thickness is preferred where the flexible quality of the layer is important. The preferred thickness is between six and twelve millimeters. The visible portion of this flexible cementitious layer is numbered 36 in FIGS. 1 and 2. The section lines 38 are formed in this layer if section lines are desired.

The upper surface of the cementitious layer is sealed with a layer of "waterproof" epoxy paint. The coating is thin and it appears as a line 40 in FIG. 2. A portion of this sealing coating is visible in FIG. 1 where it is numbered 40.

Another flexible mortar layer containing Portland cement and epoxy adhesive is laid over the sealing coat. It is numbered 44 in FIGS. 1 and 2, and it consists of one part by volume of thirty mesh silica sand, one part Portland cement, one part of the epoxy adhesive paint like that which forms coating 38, one part of the emulsion described in connection with the cementitious layer 36, and about two parts of water. After a short ten to fifteen minute quiet set period, the material is remixed and then poured and spread with a brush. It should be thicker than the coating 38, a thickness in the one to three millimeter range.

If the surface is likely to be subjected to salts, or to other chemicals or oils, or to any materials that can discolor a cement surface, it is preferred to add one or two coats of epoxy adhesive paint with an ultra-violet protection additive if out of doors. Even if, as in the case of a parking lot or roadway, the adhesive paint will wear away, the interstices of the surface of the mortar layer will be sealed.

The polymers and additives mentioned above are products which are available from a number of manufacturers. They vary somewhat in composition from manufacturer to manufacturer, but they are interchangeable.

Although I have shown and described certain specific embodiments of my invention, I am fully aware that many modifications thereof are possible. My invention, therefore, is not to be restricted except insofar as is necessitated by the prior art.

I claim:

1. A flexible cementitious overlayer for installation over the unsealed surface of a base material comprising, in combination:

a hardened underlayer of adhesive of a kind to which a combination of Portland cement and polymeric resin will adhere and which has the quality of penetrating and bonding to unsealed base material surfaces;

a layer of hardened cementitious material comprising a mixture of polymeric resins and hydrolyzed Portland cement overlying and bonded to said underlayer of adhesive; and an overlayer of epoxy adhesive paint overlying said layer of hardened cementitious material.

2. The invention defined in claim 1 which further comprises a layer of metal screening embedded in said layer of hardened cementitious material.

3. The invention defined in claim 2 which further comprises fastening means in the form of mechanical fasteners extending through said metal screening and through said adhesive underlayer for mechanically fastening said metal screening to a base material.

4. The invention defined in claim 3 in which said paint overlayer comprises a mixture of epoxy and acrylic resins and Portland cement to form a flexible water repellant outer surface with high compressive strength.

5. The invention defined in either of claims 1 or 2 in which said underlayer is less than three millimeters thick and in which said layer is between six and twelve millimeters thick.

6. The invention defined in either of claims 1 or 2 in which said underlayer and said overlayer are each less than three millimeters thick and in which said layer is between six and twelve millimeters thick.

7. The invention defined in claim 1 in which the mixture of polymeric resins comprises epoxy and acrylic resins and a lesser quantity of chlorinated vinyl rubber.

8. The invention defined in claim 7 in which said coating further comprises sand in a quantity similar by volume of Portland cement and a water emulsion of said polymeric resins.

9. The method of repairing concrete surfaces which method comprises the steps of:

(a) coating the surface of the concrete to be repaired with a thin layer of adhesive containing an epoxy resin thinned with solvants to permit penetration into any cracks and interstices opening to the surface of the concrete to be repaired;

(b) allowing the adhesive layer to dry by evaporation of the solvent;

(c) applying over said adhesive layer a flexible cementitious layer formed of trowellable mixture of water, Portland cement and an emulsion of resins including epoxy and acrylic resins; and (d) sealing said cementitious layer with a sealing coating of epoxy adhesive.

10. The invention defined in claim 9 in which the cementitious layer comprises water, sand, Portland cement and polymeric materials contained in a water emulsion and including epoxy and acrylic resins and chlorinated vinyl latex.

11. The invention defined in claim 9 which further comprises a second cementitious layer overlying and bonded to said sealing coating.

12. The invention defined in claim 11 in which said second cementitious layer is thinner than the first mentioned cementitious layer and contains a higher proportion of the epoxy and acrylic polymers than are contained in the first mentioned cementitious layer.

13. The invention defined in claim 12 which further comprises a sealing coat of epoxy adhesive paint overlying and bonded to said second cementitious layer.

14. In an overlay for masonry and stone surfaces:

an adhesive layer in the form of a thin layer of epoxy based adhesive;

a cementitious layer overlying and bonded to one side of the adhesive layer and consisting of Portland cement and polymeric materials including both epoxy and acrylic resins; and an overlayer containing an epoxy adhesive material bonded to and overlying said cementitious layer.

15. The invention defined in claim 14 in which said cementitious layer also includes a vinyl rubber additive.

16. The invention defined in claim 14 in which said overlayer comprises an epoxy based sealer overlying and bonded to said cementitious layer and a second cementitious layer containing Portland cement and epoxy and acrylic resins and chlorinated vinyl later overlying and bonded to said sealer.

17. The invention defined in claim 16 which further comprises a flexible metal reinforcing material imbedded in said first cementitious layer.

18. The invention defined in claim 16 in which said first mentioned cementitious layer exceeds six millimeters in thickness and in which said second cementitious layer is less than six millimeters in thickness.

19. The invention defined in claim 18 in which the volumetric proportion of polymeric materials is more than twice as great in said second mentioned cementitious layer than it is in said first mentioned cementitious layer.

* * * * *